US007178271B2

(12) United States Patent
Covatch

(10) Patent No.: US 7,178,271 B2
(45) Date of Patent: Feb. 20, 2007

(54) SOLE WITH IMPROVED CONSTRUCTION

(75) Inventor: Charles E. Covatch, Martinsburg, PA (US)

(73) Assignee: Columbia Insurance Company, Omaha, NE (US)

( * ) Notice: Subject to any disclaimer, the term of this patent is extended or adjusted under 35 U.S.C. 154(b) by 127 days.

(21) Appl. No.: 11/011,561

(22) Filed: Dec. 14, 2004

(65) Prior Publication Data

US 2006/0123665 A1 Jun. 15, 2006

(51) Int. Cl.
*A43B 1/10* (2006.01)

(52) U.S. Cl. ..... 36/102; 36/30 R

(58) Field of Classification Search ..... 36/102, 36/59 R, 43, 44
See application file for complete search history.

(56) References Cited

U.S. PATENT DOCUMENTS

| | | | | |
|---|---|---|---|---|
| 1,974,543 | A | 9/1934 | Reymond | |
| 2,046,217 | A | 6/1936 | Strauss | |
| 2,079,237 | A | 5/1937 | Allard | |
| 2,160,768 | A | 5/1939 | Wasser | |
| 2,307,727 | A * | 1/1943 | Hubbard | 36/59 R |
| 2,344,069 | A | 3/1944 | Wasser | |
| 2,930,149 | A * | 3/1960 | Hack et al. | 36/28 |
| 3,079,708 | A * | 3/1963 | Hack et al. | 36/28 |
| 3,087,261 | A * | 4/1963 | Russell | 36/28 |
| 3,087,262 | A * | 4/1963 | Russell | 36/28 |
| 3,091,871 | A | 6/1963 | Tronche | |
| 3,175,310 | A | 3/1965 | MacQuaid | |
| 3,175,311 | A | 3/1965 | MacQuaid | |
| 3,191,321 | A | 6/1965 | Brutting | |
| 3,213,551 | A | 10/1965 | Krauss | |
| 3,407,518 | A | 10/1968 | MacQuaid et al. | |
| 3,525,165 | A | 8/1970 | Randall, Jr. | |
| 3,561,142 | A | 2/1971 | Steit, Sr., et al. | |
| 4,231,170 | A | 11/1980 | Griswold | 36/72 |
| 4,366,629 | A | 1/1983 | Scherz | 36/4 |
| 4,562,652 | A | 1/1986 | Hensler | 36/102 |
| 4,908,963 | A | 3/1990 | Krajcir et al. | 36/77 |
| 4,995,174 | A | 2/1991 | Hong et al. | 36/72 |
| 5,048,203 | A | 9/1991 | Kling | 36/32 |
| 5,185,944 | A | 2/1993 | Okajima | 36/45 |
| 5,499,459 | A | 3/1996 | Tomaro | 36/10 |
| 5,526,584 | A | 6/1996 | Bleimhofer et al. | 36/10 |
| 5,738,937 | A | 4/1998 | Baychar | 428/316.6 |

* cited by examiner

*Primary Examiner*—Ted Kavanaugh
(74) *Attorney, Agent, or Firm*—St. Onge Steward Johnston & Reens LLC

(57) ABSTRACT

The invention relates to a shoe having a sole with a periphery and a recess. The recess extends laterally across the sole from periphery to periphery and the recess also slopes downwardly toward a rear of the shoe. An insole having a flexible material and placed on top of the recess is provided and wherein the flexible material flexes in cooperation with the recess for enhancing flexibility of the shoe.

17 Claims, 4 Drawing Sheets

SOLE WITH IMPROVED CONSTRUCTION

FIELD OF THE INVENTION

The invention relates to a sole having improved comfort and flexibility.

BACKGROUND OF THE INVENTION

Typical footwear often comprises a midsole attached to the upper along a periphery of the sole, so as to create a cavity into which a user's foot is placed, and a wear surface attached to a bottom surface of the midsole. Because the wear surface is usually in contact with the ground, the midsole is often made of a material that is softer than the wear surface but, because the midsole should resist breaking down while providing structural integrity, shock absorption, and support to the shoe, the midsole is generally tougher than cushioning material. In other types of footwear, the midsole and wear surface are combined and such combination is usually called an outsole.

Whether a shoe uses a midsole or outsole, consumers often use comfort as at least one basis for purchasing a particular shoe over a competitor's shoe. Therefore, manufacturers have longed to improve comfort of their shoes, which is often achieved by placing resilient or cushioning material between a user's foot and a top surface of the midsole or outsole, both of which are hereinafter generally defined as a sole. However, due to repeated foot strikes, particularly in the heel and balls of the foot areas, the cushioning material often breaks down or becomes flattened. In some cases, the breakdown of the cushioning is so severe that the user may discard the shoe even though other parts of the shoe are usable.

Furthermore, by merely adding more cushioning material to a shoe, the likelihood of retaining moisture and/or bacteria in the cushioning material is also increased. Therefore, adding cushioning may also disadvantageously introduce odors or fungi.

In some other types of footwear, grooves in the sole were provided to enhance comfort. U.S. Pat. No. 3,087,261 (Russell), U.S. Pat. No. 3,087,262 (Russell), U.S. Pat. No. 4,638,577 (Riggs), U.S. Pat. No. 4,658,514 (Shin), and U.S. Pat. No. 4,498,251 (Shin) seem to relate to soles with grooves for enhancing comfort or flexibility. However, the grooves do not appear to extend substantially across a width of the shoe because doing so would negatively affect stability or support. As a result, the shoe may not have optimal comfort or flexibility due to the possible introduction of instability.

Similarly, U.S. Patent No. to Aoki seems to have holes in a heel to enhance flexibility or comfort but the holes do not substantially traverse across the entire width of the shoe. Again, the shoe may not have optimal comfort or flexibility due to the possible introduction of instability.

Both U.S. Pat. No. 3,079,708 to Hack and U.S. Patent Publication No. 2002/0189132 to Yamamoto seem to relate to shoes having grooves for enhancing comfort or flexibility but, because the grooves are so large, the grooves themselves may offset the comfort or flexibility that they provide. These references may employ a covering for the grooves to provide an even surface for the user. However, such a covering may reduce overall flexibility of the shoe.

What is desired, therefore, is a shoe having improved comfort and flexibility. Another desire is a shoe having optimal comfort and flexibility without sacrificing stability.

A still further desire is to reduce bacteria or moisture accumulation in the shoe while optimizing comfort and flexibility.

SUMMARY OF THE INVENTION

It is, therefore, an object of the invention to provide a shoe that optimizes comfort without sacrificing stability.

Another object is to provide a shoe that improves flexibility while reducing germs or fungi.

These and other objects of the invention are achieved by a shoe having a sole with a periphery and a recess. The recess extends laterally across the sole from periphery to periphery and the recess also slopes downwardly toward a rear of the shoe. An insole having a flexible material and placed on top of the recess is provided and wherein the flexible material flexes in cooperation with the recess for enhancing flexibility of the shoe.

In some embodiments, the sole is a midsole. In other embodiments, the sole is an outsole.

The top surface of the sole may further include a notch for enhancing flexibility. In other variations, the sole may also have a plurality of recess for further enhancing comfort.

In some embodiments, the recess is between a top surface and a bottom surface of the sole. In further embodiments, the recess extends from a top surface of the sole. In still other embodiments, the recess extends from a bottom surface of the sole.

In another aspect of the invention, the flexible material flexes in cooperation with the notch for enhancing flexibility of the shoe.

Optionally, the recess may be curved to facilitate flexing in various directions.

In all versions of the invention, the recess and notch are without a supporting rib to maintain stability.

DETAILED DESCRIPTION OF THE DRAWINGS

Figure 1:
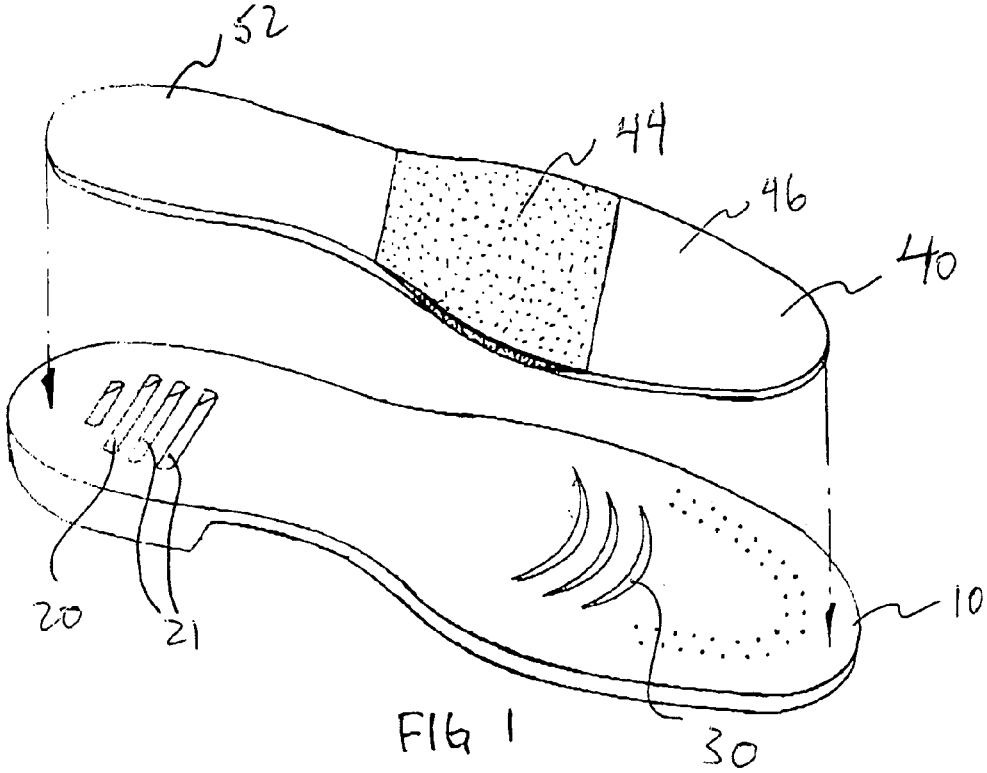
FIG. 1 depicts the improved sole and insole in accordance with the invention.

FIG. 1 depicts improved sole 10 and insole 40 in accordance with the invention. As shown, sole 10 includes recess 20 and notch 30. Recess 20 improves the cushioning effect of sole 10 as sole 10 is compressed by the user's foot. The greater the quantity of recess 20, the more enhanced the cushioning effect. In this fashion, the material of sole 10 may play less of a role in the amount of comfort sole 10 provides, and the overall shoe of which sole 10 is a part, because even a tough or brittle material may provide enhanced cushioning to the user's foot due to recess 20 or plurality 21 of recesses.

Figure 2:
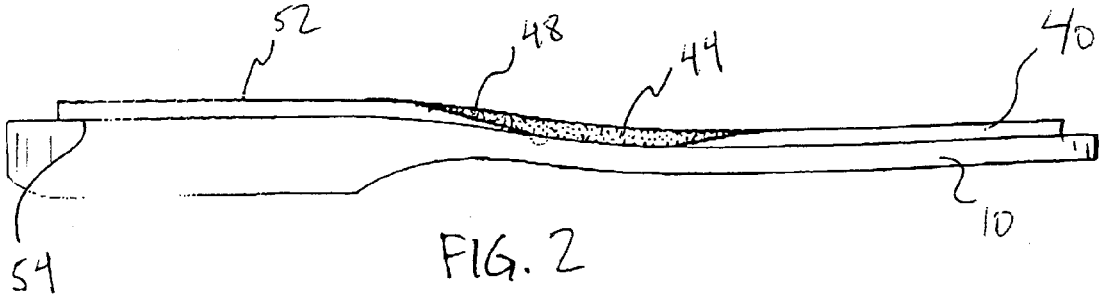
FIG. 2 depicts a side view of the improved sole and insole shown in FIG. 1.

The invention further includes insole 40 having flexible material 44, where flexible material 44 may or may not be integrally formed with remainder 46 of insole 40. See FIGS. 1–2.

Insole 40 is often secured to both an upper of the shoe and sole 10. Hence, insole 40 is a significant element of shoe 10 because a weak, or lack of structural integrity in, insole 40 may cause the upper or sole 10 to separate from insole 40 since any fastener or stitch, which may be used to secure the upper or sole 10 to insole 40, would lack an anchoring mechanism to which to be secured.

For example, if a screw or rivet is used to secure insole 40 to sole 10, the hole through which the screw or rivet passes may stretch around and loosen insole 40 from the screw or rivet.

Therefore, insole 40 is made of a rigid material having sufficient structural integrity to provide an anchoring mechanism to which the upper and/or sole 10 is secured. Generally, insole 40 is made of fiber board, leather, synthetic materials, rubber, and the like.

Figure 3:
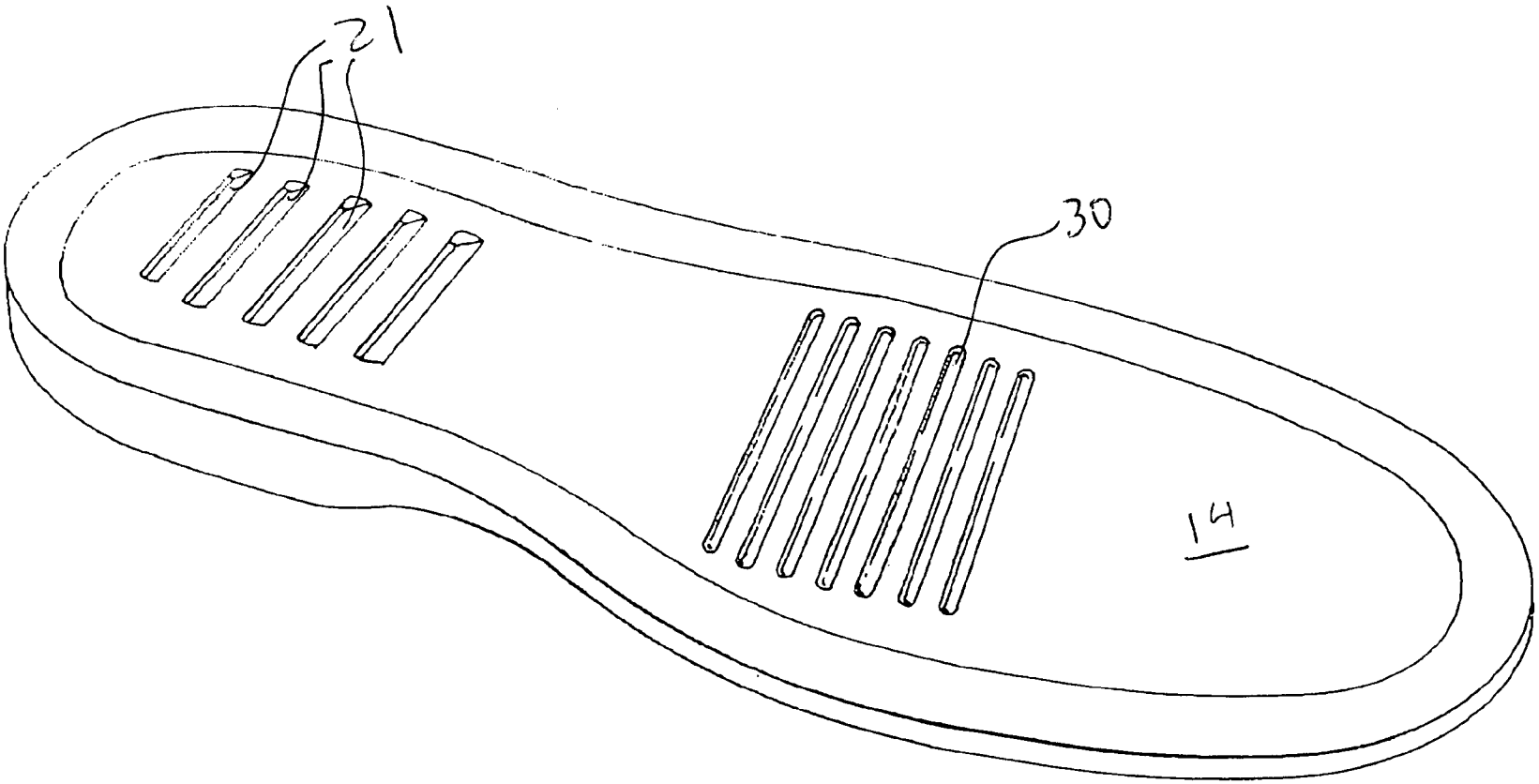
FIG. 3 depicts an isometric view of the insole shown in FIG. 1.
Figure 4:
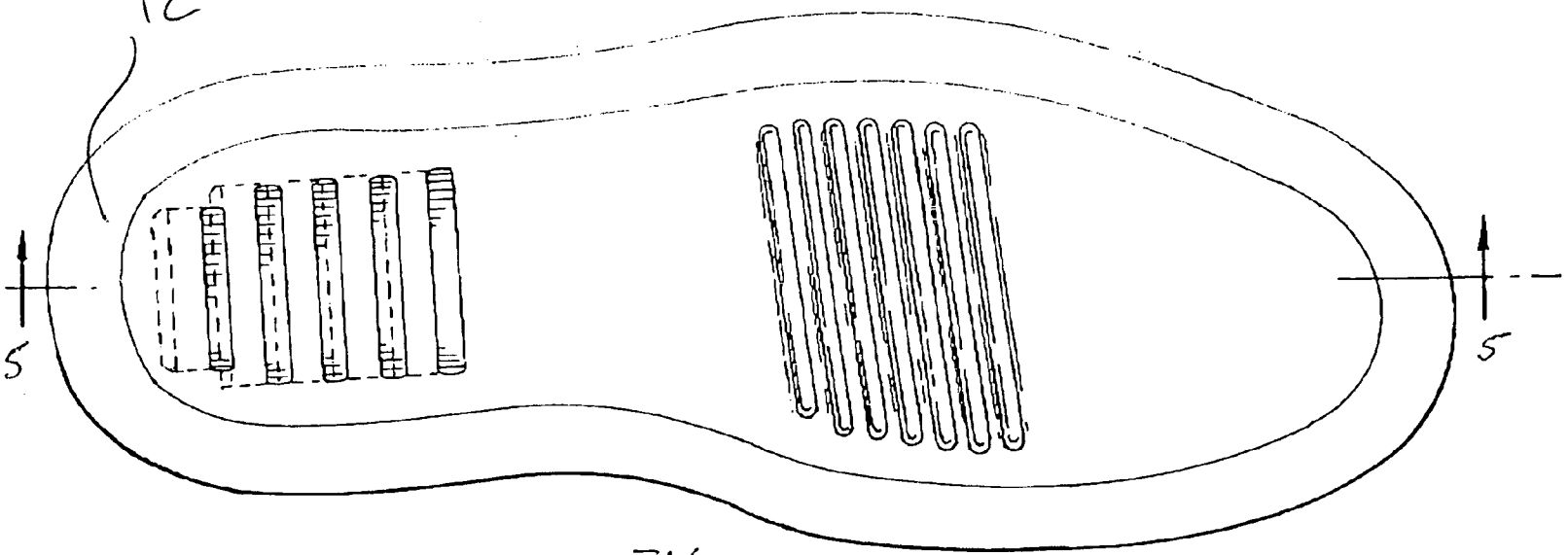
FIG. 4 depicts a top view of the insole shown in FIG. 1.
Figure 5:
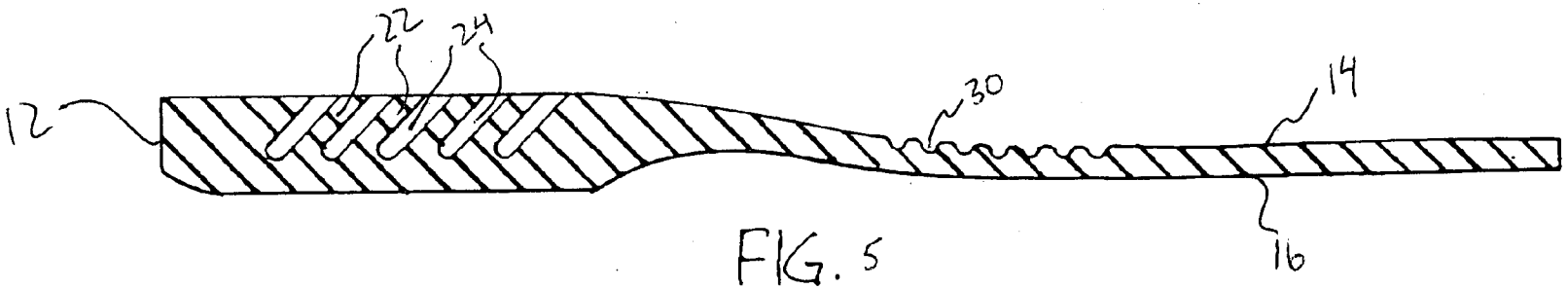
FIG. 5 depicts a cross sectional view of the insole shown in FIG. 1.

Referring to FIGS. 3–5, the cushioning effect of recess 20 lies in the angle of recess 20 as recess 20 slopes rearwardly and downwardly toward rear 12 of sole 10. The angle of recess 20 is between approximately 1 and 89 degrees with top surface 14, more preferably between approximately 30 and 45 degrees with top surface 14, and most preferably between approximately 33 and 37 degrees with top surface 14. This is more particularly shown in FIGS. 2–3.

As the user's foot compresses sole 10, and more specifically recess 20, the walls 22 of recess 20 yield, or partially collapse, into void 24 formed by recess 20. The yielding of walls 22 act like a shock absorber. Plurality 21 of recesses further enhance the cushioning effect of sole 20 because additional voids 24 distribute and absorb a greater amount of weight caused by the user's foot by dispersing the weight across many voids 24 as opposed to one void 24.

As shown, although recess 20 is depicted to extend from top surface 14 of sole 10 and slope rearwardly, in other embodiments, recess 20 may be embedded within sole 10 where recess 20 extends downwardly and rearwardly from a point between top and bottom surfaces 14, 16 to another point between top and bottom surfaces 14, 16.

Also shown in FIGS. 3–5 is notch 30 in top surface 14. Notch 30 is an absence of material from top surface 14. Less material in sole 10 permits sole 10 to bend more easily since there is less resistance.

Figure 6:
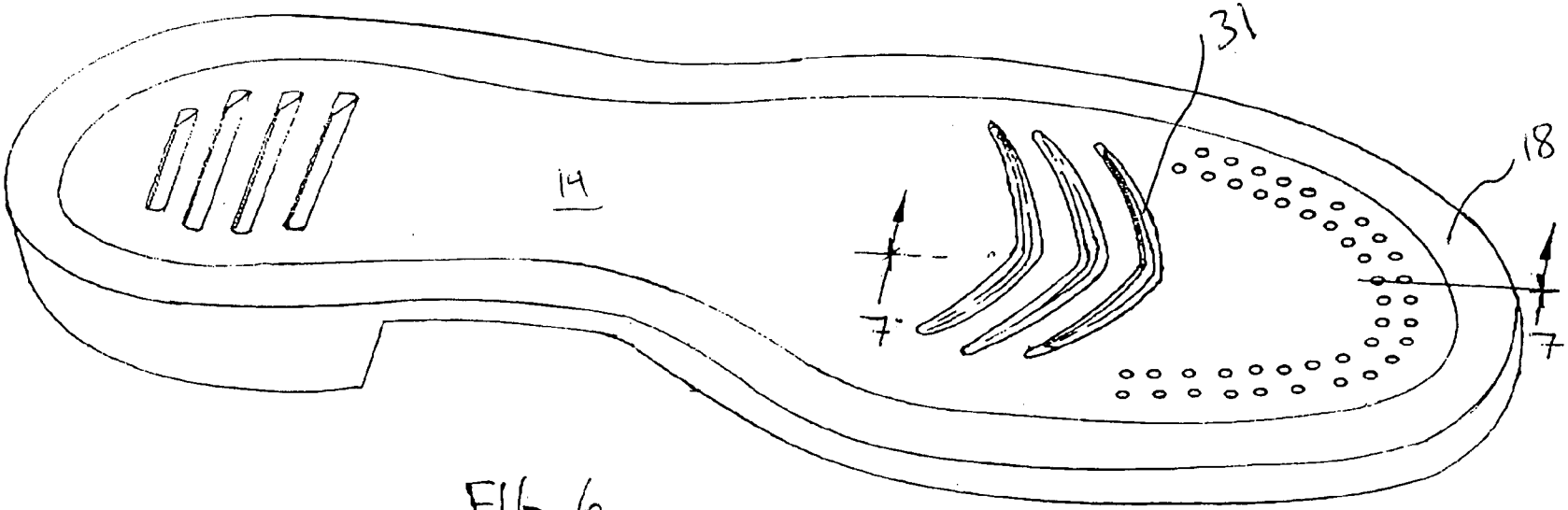
FIG. 6 depicts an isometric view of another embodiment of the notch shown in FIG. 1.
Figure 7:
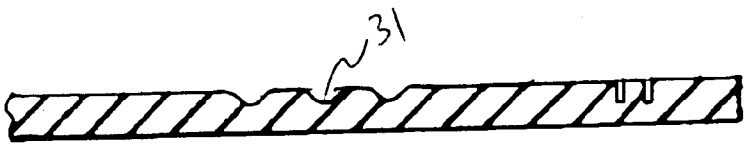
FIG. 7 depicts a cross sectional view of another embodiment of the notch and insole shown in FIG. 1.

FIG. 6 depicts notch 31 being curved or angled about an axis perpendicular to top surface 14, so that sole 20 may more easily flex in the direction of the curve or angle. This variance of notch 31 from notch 30 may be advantageous for a user who moves or desires flexing in directions other than toward front part 18 of sole 10, such as a user who participates in athletic activities.

In some embodiments, insole 40 may include a hole, which may be a through hole extending from top surface 52 to bottom surface 54 of insole 40, or which may be a hole that extends partially through a thickness of insole 40, either from top or bottom surface 52, 54 to a location between the two surfaces.

By removing material from insole 40 by providing a hole, the flexibility of insole 40 is enhanced because there is less rigid material and, therefore, less resistance inhibiting insole 40 from bending when worn by a user. Yet, because the remainder of insole 40, particularly periphery 56 of insole 40, is made of the rigid material, insole 40 maintains sufficient structural integrity.

Although the hole enhances flexibility, a hole extending from top surface 52 to bottom surface 54 may cause discomfort or an uneven feeling to the user because the user's foot not be adequately supported when the foot is placed above the hole.

To alleviate this discomfort, while still enhancing flexibility, the hole may be placed in select areas of insole 40, such as the arch area of sole 10 since the lack of support for the arch of the user's foot due to the hole in insole 40 may be overcome by providing adequate support with a footbed, or cushion placed on top surface 52.

In another aspect of insole 40, the hole may extend partially through a thickness of insole 40 from bottom surface 54 to a location between top and bottom surfaces 52, 54. In this aspect of the hole, top surface 52 is relatively flat so as to receive the user's foot without the uneven feeling, yet material is removed from insole 40 for enhancing flexibility.

Flexible material 44 may optionally be placed within the hole in any of the above aspects of insole 40 to alleviate discomfort due to a lack of support from the user's foot being placed above the hole. Flexible material 44 is any material permitting ample flexing when the shoe is worn. Examples of flexible material 44 include fabric, foam, rubber, cork, and the like.

In aspects of insole 40 having flexible material 44, the hole, whether partially extending through or all the way through the thickness of insole 40, may extend from top surface 52 without concern for the uneven feeling described above since flexible material 44 would occupy hole 48.

In addition to permitting ample flexing, flexible material 44 may also enhance comfort to the user since flexible material 44 provides resiliency, characteristic of a footbed or cushion placed above insole 40. It is understood that the shape and placement of the hole and flexible material 44 is not limited to those described above. In some embodiments, hole 48 is placed in an arch region. In further embodiments, hole 48 is placed in a plurality of areas of insole 40. Also, the shape of the hole need not be symmetric or have uniform depth through a thickness of insole 40. Any variation of shape or location is envisioned by the invention.

What is claimed is:

1. A shoe, comprising:

a sole having a periphery and a recess;

said recess extending laterally and continuously across said sole from periphery to periphery;

said recess slopes downwardly toward a rear of the shoe;

an insole having a rigid material and a flexible material, where said flexible material is placed on top of said recess; and wherein said flexible material flexes in cooperation with said recess for enhancing flexibility of the shoe.

2. The shoe according to claim 1, wherein said sole is a midsole.

3. The shoe according to claim 1, wherein said sole is an outsole.

4. The shoe according to claim 1, further comprising a notch in a top surface of said sole for enhancing flexibility.

5. The shoe according to claim 1, further comprising a plurality of recesses.

6. The shoe according to claim 1, wherein said recess is between a top surface and a bottom surface of said sole.

7. The shoe according to claim 1, wherein said recess extends from a top surface of said sole.

8. A sole, comprising:

a sole having a recess a periphery and a notch;

said recess slopes downwardly and continuously across said sole from periphery to periphery toward a rear part of the shoe;

said notch being in a top surface of said sole for enhancing flexibility;

an insole having a rigid material and a flexible material, where said flexible material is and-placed on top of said notch; and wherein said flexible material flexes in cooperation with said notch for enhancing flexibility of the shoe.

9. The shoe according to claim 8, further comprising a plurality of recesses and notches.

10. The shoe according to claim 9, wherein said flexible material is placed on top of said plurality of notches.

11. The shoe according to claim 8, wherein said notch is curved.

12. A shoe, comprising:

a midsole having a recess and a periphery;

said recess extending laterally and continuously across width of said midsole from periphery to periphery;

said recess slopes downwardly and toward a rear of said midsole;

a notch in a top surface of said midsole for enhancing flexibility;

an insole having a rigid material and a flexible material, where said flexible material is placed on top of said notch; and wherein said recess and said notch extend downwardly toward a bottom surface of said midsole without penetrating said bottom surface.

13. The shoe according to claim 12, further comprising a plurality of recesses and notches.

14. The shoe according to claim 13, wherein said plurality of recesses are without a supporting rib connecting said plurality of recesses together.

15. A shoe, comprising:

a sole having a left side, a right side, and a top surface;

said sole includes at least one recess in a rear area of said top surface and at least one notch in a fore area of said top surface;

said at least one recess and said at least one notch extending laterally and continuously across said sole from said left side to said right side;

said at least one recess slopes downwardly toward a rear of the shoe;

an insole having both a rigid material and a a flexible material, where said flexible material is placed above said at least one notch; and wherein said flexible material flexes in cooperation with said recess for enhancing flexibility of the shoe.

16. The shoe according to claim 15, wherein said insole further comprises another flexible material placed above said at least one recess.

17. The shoe according to claim 15, wherein said left side and said right side are proximate to an outer periphery of said sole.

* * * * *